US005438176A

United States Patent [19]

Bonnardel et al.

[11] Patent Number: 5,438,176

[45] Date of Patent: Aug. 1, 1995

[54] THREE-POSITION SWITCH ACTUATING MECHANISM

[75] Inventors: Patrick Bonnardel, Grenoble; Bernard Jacquemet, St. Simeon de Bressiuex; Jean-Charles Broize, Voreppe; André Odier, Grenoble, all of France

[73] Assignee: Merlin Gerin, France

[21] Appl. No.: 132,349

[22] Filed: Oct. 6, 1993

[30] Foreign Application Priority Data

Oct. 13, 1992 [FR] France ..... 92 12390

[51] Int. Cl.[6] ..... H01H 5/06

[52] U.S. Cl. ..... 200/400

[58] Field of Search ..... 200/400, 401, 440, 320–333; 375/76, 189, 171

[56] References Cited

U.S. PATENT DOCUMENTS

| | | | |
|---|---|---|---|
| 4,019,008 | 4/1977 | Kohler et al. | 200/400 |
| 4,153,828 | 5/1979 | Barkan | 200/400 |
| 4,404,446 | 9/1983 | Maier et al. | 200/320 |
| 4,439,653 | 3/1984 | Umino et al. | 200/400 |
| 4,578,551 | 3/1986 | Lin | 200/400 |
| 4,821,008 | 4/1989 | Micoud et al. | 335/189 |
| 4,845,324 | 7/1989 | Martin et al. | 200/400 |
| 4,916,268 | 4/1990 | Micoud et al. | 200/400 |
| 5,004,875 | 4/1991 | Moody et al. | 200/400 |
| 5,107,715 | 4/1992 | Thuries | 20/400 X |
| 5,113,056 | 5/1992 | Kuhn | 200/400 |
| 5,148,913 | 9/1992 | Bonnardel et al. | 200/400 |

FOREIGN PATENT DOCUMENTS

| | | |
|---|---|---|
| 0277851 | 8/1988 | European Pat. Off. . |
| 0448481 | 9/1991 | European Pat. Off. . |

*Primary Examiner*—Renee S. Luebke
*Attorney, Agent, or Firm*—Parkhurst, Wendel & Rossi

[57] ABSTRACT

An actuating mechanism of a three-position switch, the switch comprising a main shaft supporting or actuating contacts and able to be moved selectively to three stable positions and a center crank which is pivotally mounted and can be actuated so as to take the three positions of the main shaft, the mechanism in addition having a mechanical system which produces a kinetic ratio between the angular movement of the center crank and that of the main shaft which increases when the center crank moves from the open position to the closed position, which results in the force transmitted to the electrical contacts increasing continuously as movement takes place from the open position to the closed position.

7 Claims, 8 Drawing Sheets

UNLOADED OPEN POSITION

THREE-POSITION SWITCH ACTUATING MECHANISM

BACKGROUND OF THE INVENTION

The present invent ion relates in a general manner to an actuating mechanism of a three-position switch, the switch comprising a main shaft supporting or actuating electrical contacts and able to be moved selectively to three stable positions, a center position or an open position, a switch closed position and an earthed closed position, the main shaft being connected by levers, on the one hand to a first switch closing and opening operating device and on the other hand to a second earthing closing and opening operating device.

A state-of-the-art operating mechanism of the kind mentioned above comprises two operating devices which cooperate with a single spring imposing high-speed operations of said main shaft, so that the levers transmit an increasing torque to the main shaft from the center position to the switch closed and earthed closed positions, at the dead point of stable locking of the main shaft.

An operating mechanism of this kind does not enable an increasing force to be obtained on closing of the switch and a decreasing force to be obtained on opening of the switch.

Moreover, a mechanism of this kind does not enable high-speed actuation with release of energy to be achieved at the same time for the switch closing, opening and earthing closing operations.

Moreover, a mechanism of this kind does not enable assembly to be achieved, using the same parts, either according to a configuration in which the action a user has to perform to trigger closing of the switch is a single movement performed on a single part, or another configuration in which the action a user has to perform to trigger closing of the switch is a loading action and an independent triggering action.

One object of the invention is to provide a mechanism which does not present the shortcomings set out above with respect to mechanisms of the prior art.

SUMMARY OF THE INVENTION

According to one feature of the invention, the actuating mechanism of a three-position switch comprises : a main shaft supporting or actuating contacts and able to be/moved selectively to three stable positions, an open position and, on each side of this open position, respectively a switch closed position and an earthed closed position; and a center crank which is pivotally mounted with respect to a fixed frame of the mechanism and which can be actuated so as to be able to take three angular pivoting positions corresponding respectively to said three stable positions, the mechanism comprising a mechanical movement transformation system which produces a kinetic ratio between the angular movement of the center crank and that of the main shaft which increases when the center crank moves from the open position to the switch closed position, which results in the force transmitted to the electrical contacts increasing continuously as movement takes place from the open position to the switch closed position.

According to an embodiment of the invention, the actuating mechanism comprises a first spring and a second spring, these two springs being compressed simultaneously when the actuating mechanism is in the loaded open position with a view to moving to the switch closed position, wherein moving from the open position to the switch closed position is triggered by relaxation of the first spring and moving from the switch closed position to the open position is triggered by relaxation of the second spring.

According to an alternative embodiment of the invention, the second spring is also compressed when the actuating mechanism is in the open position with a view to moving to the earthed closed position, and moving from the open position to the earthed closed position is triggered by relaxation of the second spring.

According to another alternative embodiment of the invention, the first spring also serves the purpose of slowing down the beginning of closing, by exerting a thrust on a second spring loading plate in a certain direction at the beginning of the earthing closing movement, this thrust then being reversed, when a dead point is passed, near the end of the earthing closing movement.

According to another alternative embodiment of the invention, the mechanism comprises a center crank rigidly coupled to a center cam, these two parts pivoting together around the spindle of the main shaft and being connected to said movement transformation system in order to control the latter to actuate the electrical contacts via the main shaft, and a loading plate pivoting independently around the spindle of the main shaft. The first spring is inserted between a first crankshaft and the center crank, the second spring is inserted between a second crankshaft and the loading plate, the first crankshaft enables the first spring to be loaded with a view to switch closing and is coupled to a drive cam which actuates the loading plate in order to simultaneously load the second spring for the purposes of opening, and the second crankshaft enables the second spring to be loaded with a view to earthing closing.

According to another alternative embodiment of the invention, the end of the second spring opposite from the second crankshaft is connected to a spindle which is connected to the loading plate and which is also mounted with sliding in a circular slot arranged in the main cam, in such a way that the loading plate serves the purpose of loading the second spring whereas the spindle slides in the circular slot, that relaxation of the first spring causes pivoting of the main cam in a certain direction whereas the spindle remains fixed and the circular slot slides with respect to the spindle, and that relaxation of the second spring causes movement of the spindle which comes up against one end of the circular slot giving rise to an impact and causing pivoting of the main cam in the opposite direction.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
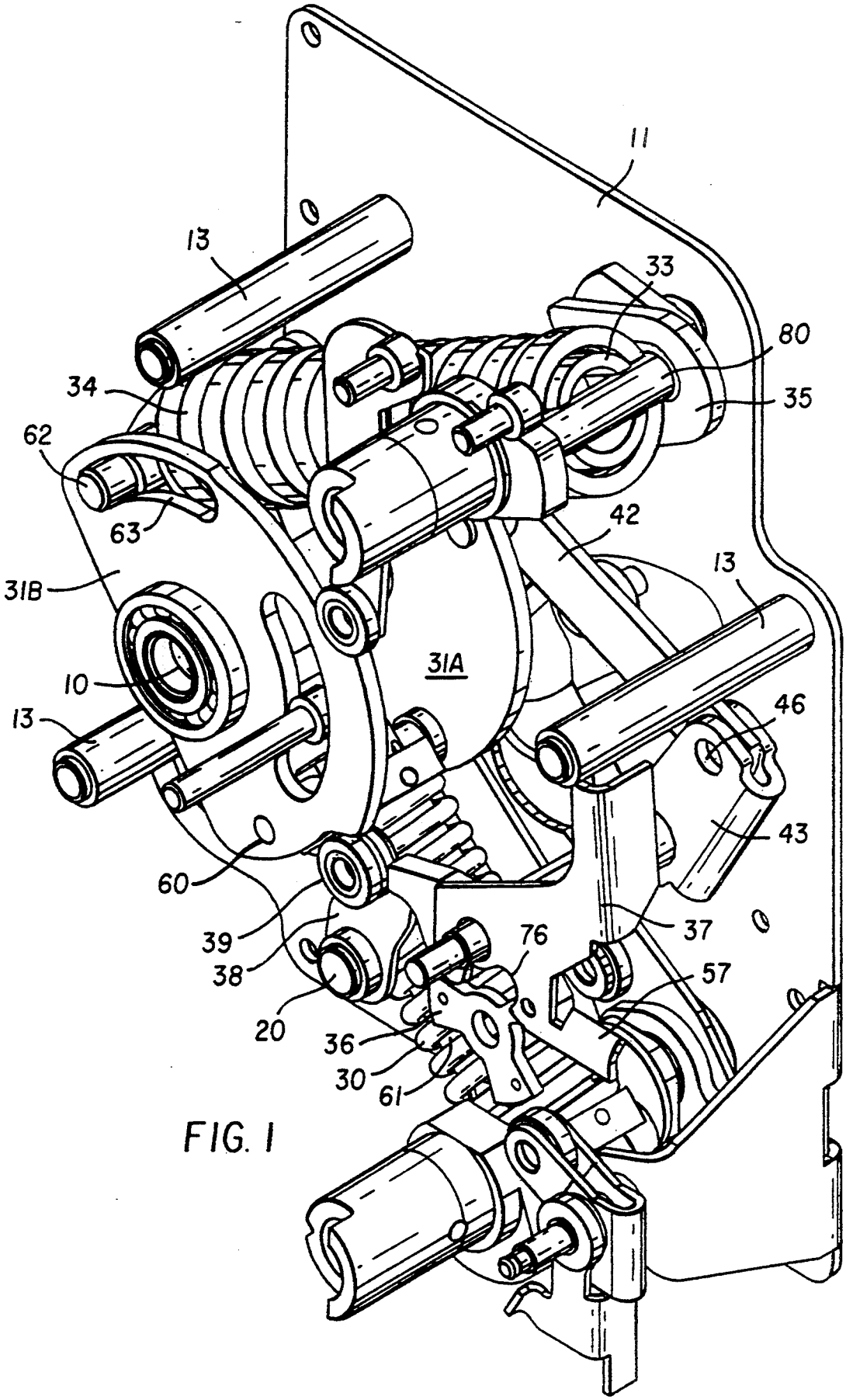
FIG. 1 is a schematic perspective view of a mechanism according to the invention, the front flange having been removed in order to make the drawing clearer, the switch being in the unloaded open position.

In FIG. 1, a main shaft 10 (only the top end of which can be seen) is pivotally mounted on an upper flange (not represented) and a lower flange 11 and supports or actuates electrical contacts (not represented) in order to be able to move the switch selectively to three stable positions, a center position or switch open position, a switch closed position and a closed earthed position. The lower flange 11 and upper flange (not represented) are formed by parallel flat plates and are connected to one another by three spacers 13, in such a way that the actuating mechanism assembly according to the invention is essentially housed between the two flanges which act as fixed or pivoting supports for the different parts which make up this mechanism. The switch open position C1 corresponds to the open position of the electrical contacts and the switch closed position C2 and closed earthed position C3 are Situated on each side with respect to the switch open position C1 (FIG. 2).

Figure 2:
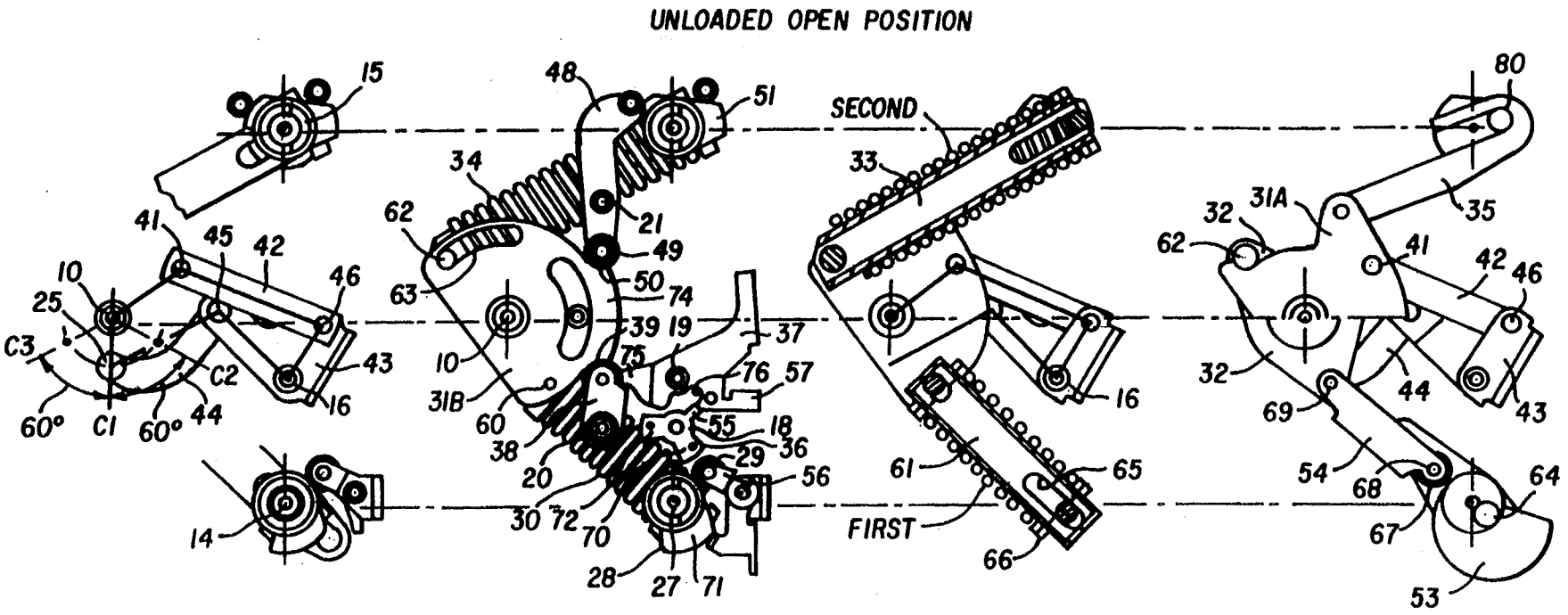
FIG. 2 is an exploded view of the mechanism of FIG. 1 in the unloaded open position.

In FIG. 2, the actuating mechanism of FIG. 1 can be seen in the switch open position C1. In this figure, the essential parts of the mechanism have been represented in simplified manner simultaneously in four different graphic modes illustrating the same mechanism in the same position but according to different simplified illustration modes, in order to enable a better understanding to be had of operation of the parts of the mechanism. The same mode of representation has been used for FIGS. 3 to 8. Each FIG. 2 to 8 comprises from left to right four drawings respectively representing a movement transformation system, a part of the mechanism including-two springs, the position of the two springs and the transmission mode of the forces between the springs and the other parts.

In FIG. 2, the shaft 10 is driven by a drive finger 25 which is, in this figure, situated in the position which corresponds to the switch open position C1. It can be seen that this drive finger 25 can move over an arc of a circle around the main shaft 10, on each side of this switch open position, through about 60°. If the drive finger 25 is moved to the right in the drawing, it will drive the main shaft 10 to the switch closed position C2, and if the drive finger 25 is moved to the left in the drawing, it will drive the main shaft 10 to the closed earthed position C3.

The mechanism comprises a movement transformation system which operates in the following way. A center crank 31A is pivotally supported around the main shaft 10 and is connected by an articulation, comprising a transformation operating spindle 41, to one end of a secondary transformation connecting rod 42 the other end of which is connected by an articulation, comprising a transformation counterspindle 46, to a transformation countergear 43 which is pivotally mounted around a fixed transformation system counterspindle 16. The transformation countergear 43 is a part having a general L shape forming two rigid branches appreciably perpendicular to one another, one of said branches connecting the spindle 16 to a transformation operating spindle 45 which enables the transformation countergear 43 to be connected by articulation to one end of a main drive rod 44 the other end of which is connected by articulation to the drive finger 25 of the main shaft 10. The pivoting movement of the center crank 31A enables the three positions C1, C2 and C3 of the drive finger 25 of the main shaft 10 to be commanded selectively, by means of the transformation system which has just been described.

A switch operating spindle 14 is connected to a handle or any actuating device (not represented) enabling the switch to be operated to move it to the closed position C2. An earthing operating spindle 15 is connected to another handle or any actuating device (not represented) enabling the switch to be operated to move it to or from the closed earthed position C3. A first switch closing and opening control device is provided (which will be described further on) which is actuated by the switch operating spindle 14 and a second earthing closing and opening control device is provided (which will be described further on) which is actuated by the earthing operating spindle 15.

The first and second closing and opening control devices are now described. A first spring 30 is arranged in a general manner between the switch operating spindle 14 and an articulation having a spindle 60 located on a center cam 31B. The center crank 31A and center cam 31B are mounted on the same pivoting spindle and are rigidly joined to one another. Consequently, pivoting of one of these two parts through a certain angle causes pivoting of the other part through the same angle. The first spring 30 is mounted on a first spring guide 61 one of whose ends is connected to the spindle 60 and the other of whose ends is secured at the level of the spindle 14. The second spring 34 is arranged in a general manner between the earth operating spindle 15 and a second spring end spindle 62. The second spring 34 is mounted on a second spring guide 33 one of whose ends is connected to the spindle 62 and the other of whose ends is held at the level of the spindle 15. One end of the second spring 34 bears against the second spring guide 33 near the spindle 62 and, likewise, one end of the first spring 30 bears against the first spring guide 61 near the spindle 60. The spindle 62 is engaged in a circular slot 63 arranged in the center cam 31B, in such a way as to be able to slide in this slot 63 over a certain length of an arc centered around the main shaft 10.

Figure 3:
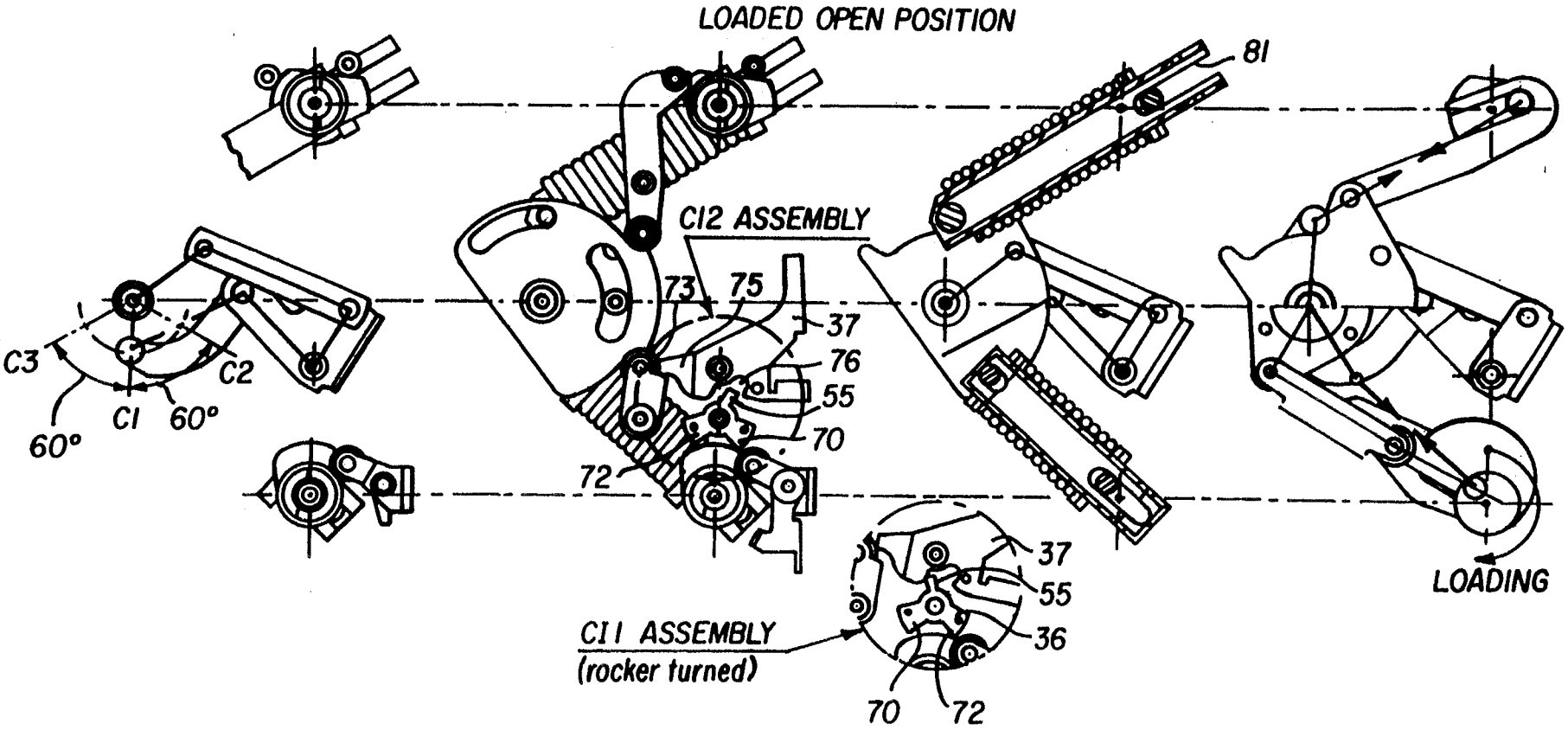
FIG. 3 is an exploded view of the mechanism of FIG. 1 in the loaded open position with a view to switch closing.

A certain rotation of the switch operating spindle 14 simultaneously causes compression of the first spring 30 and compression of the second spring 34, as will be described in greater detail further on. This rotation of the switch operating spindle 14 corresponds to loading of the switch, i.e., to actuation of the switch by a person in order to move it from the unloaded switch open position (FIG. 2) to the loaded switch open position (FIG. 3).

The mechanisms enabling these compressions of the springs 30 and 34 to be achieved are explained in detail now. On the switch operating spindle 14 there are rigidly mounted a first spring loading crankshaft 27 and a second spring loading cam 53. Consequently, the operation consisting in making the spindle 14 rotate through a certain angle causes rotation through the same angle of both the part 27 and the part 53. The first spring loading crankshaft 27 comprises an eccentric first spring loading spindle 64 which moves in a first spring guide slot 65 bearing against a bearing part 66, in such a way that rotation of the crankshaft 27 causes movement of the spindle 64 in the slot 65, this movement causing corresponding movement of the bearing part 66 and compression of the first spring 30 whose distal end is bearing against the bearing part 66. When we go from FIG. 2 to FIG. 3, the crankshaft 27 rotates through about 180° and thus causes compression of the first spring 30. At the same time, the second spring loading cam 53 has a cam surface which is bearing against a roller 67 mounted on a distal end of a second spring loading rod 54. This roller rotates around a spindle 68. The second spring loading rod 54 can slide in a slot (not visible in the drawings because it is behind the rod 54) arranged in a fixed guiding part 69, this slot being oriented appreciably radially with respect to the rotation axis of the spring operating spindle 14. This has the result that a rotation of about 180° of the second spring loading cam 53 causes movement of the roller 67 and consequently of the second spring loading rod 54 whose proximal end is connected by an articulation 69 to a second spring loading plate 32 which is pivotally mounted around the main shaft 10. The appreciably longitudinal movement of the second spring loading rod 54 causes pivoting of the second spring loading plate 32. As the distal end of the second spring guide 33 comprises a spindle 62 which is mounted on the same second spring loading plate 32, pivoting of the latter causes movement of this spindle 62 and consequently compression of the second spring 34, as can be seen when considering the passage from FIG. 2 to FIG. 3. The second spring 34 can in fact be compressed due to the movement of the spindle 62, because its distal end is at the same time held fixed at the level of the earth operating spindle 15. As the first spring loading crankshaft 27 and second spring loading cam 53 rotate in unison with the switch operating spindle 14, rotation of this spindle through about 180° (moving from the position of the mechanism in FIG. 2 to the position of the mechanism in FIG. 3) effectively enables the first spring 30 and second spring 34 to be compressed simultaneously, i.e. the mechanism to be moved from an unloaded-switch open position (FIG. 2) to a loaded switch open position (FIG. 3).

Figure 4:
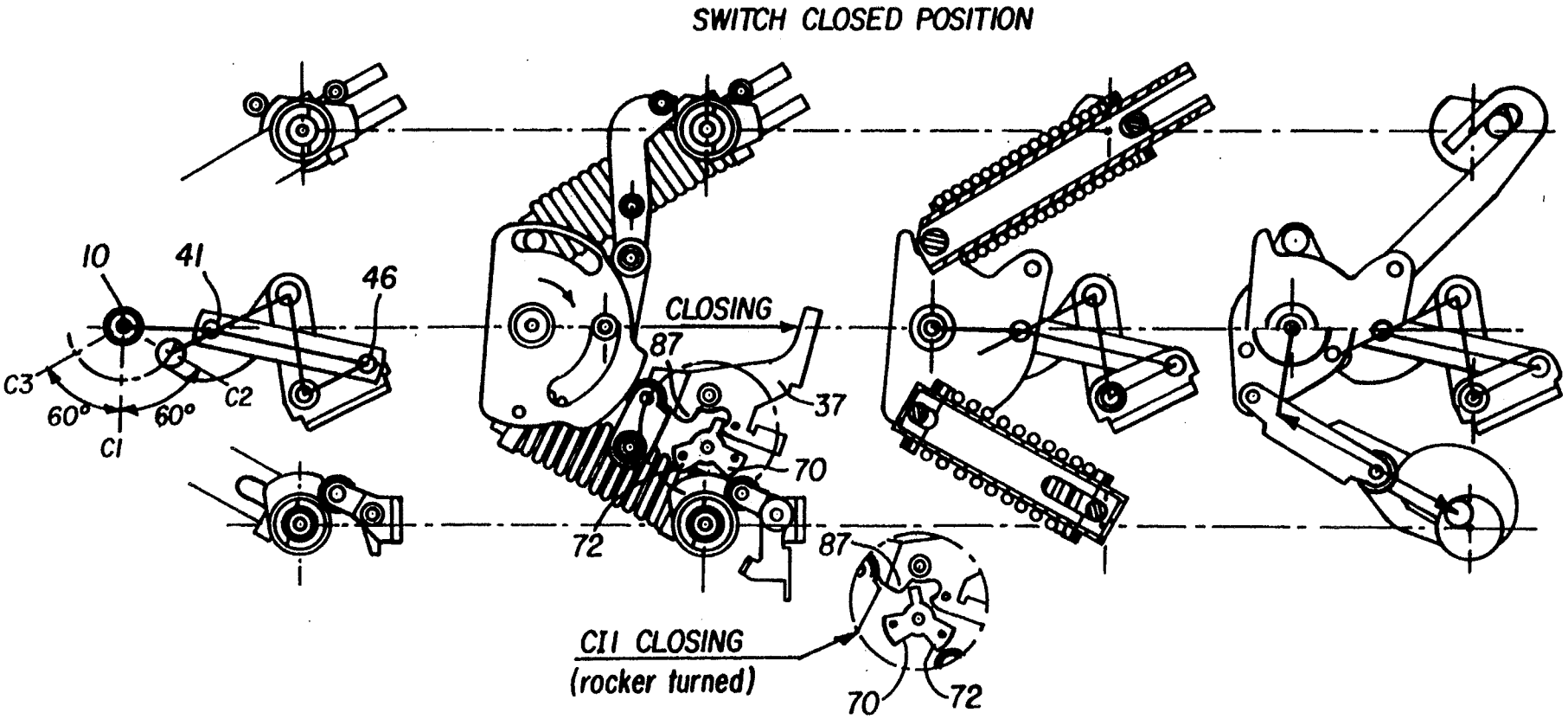
FIG. 4 is an exploded view of the mechanism of FIG. 1 in the switch closed position.

When the mechanism remains loaded in this way (FIG. 3), both the springs are compressed and the mechanism is ready to be tripped in order to move at high speed from the switch open position C1 to the switch closed position C2 (FIG. 4). This triggering is achieved by operation of a mechanism which will be described now. This mechanism comprises a rocker 36 which is formed by a part mounted with pivoting on a rocker spindle 18. The crankshaft 27 comprises a lateral protuberance 71 forming a rocker operating face 28 which, when the crankshaft 27 is rotated to the loaded position of FIG. 3, comes and pushes a corresponding bearing face 70 of the rocker 36 thus making the rocker 36 pivot slightly (counterclockwise in the drawing in FIG. 3). A cylindrical surface forming the external limit of the protuberance 71 and set back with respect to the rocker operating face 28 is then situated facing and near the rocker 36 (FIG. 3) and, in this position, both the bearing face 70 of the rocker 36 and a radial protuberance 72 of this rocker 36 come up against or close to the cylindrical surface of the protuberance 71 of the crankshaft 27, in such a way that the rocker 36 is rotated through a certain angle and is then immobilized, as represented in FIG. 3. A latching finger 55 is also provided on the rocker 36 and this latching finger 55 forms on the rocker 36 a radial protuberance which is appreciably directed in the opposite direction from the switch operating spindle 14. The mechanism comprises in addition a closing latch 38 which is formed by a small rod one of whose ends is pivotally mounted around a fixed locking spindle 20 and the other of whose ends comprises a locking roller 73 which, in the loaded switch open position (FIG. 3), bears against a latching before closing surface 39 which is arranged appreciably radially at the level of the circumference of the center cam 31B.

The mechanism comprises in addition a secondary latch 37 which is formed by a part pivotally mounted around a fixed secondary latch spindle 19 and which comprises a locking finger 75 which, in the loaded switch open position (FIG. 3), comes and locks the roller 73 to hold it against the latching surface 39 thus preventing clockwise rotation of the center cam 31B. The secondary latch 37 comprises in addition a switch closing triggering arm 57 and a recess 76 which is located, in the loaded switch open position of FIG. 3, facing the latching finger 55 of the rocker 36. This has the result that, in the loaded switch open position of FIG. 3, the switch closing triggering arm 57 can be acted on by pushing it so as to make the secondary latch 37 pivot clockwise, this pivoting being possible due to the fact that the latching finger 55 is located facing the recess 76 and that during the pivoting the latching finger 55 engages in the recess 76 without hindering this pivoting. This clockwise pivoting of the secondary latch 37 causes an upward movement of the locking finger 75 and disengages it from the roller 73, resulting in the roller 73 moving away from the surface of the center cam 31B, due to the thrust action of the first compressed spring 30, and the center cam 31B is then released and can pivot clockwise at high speed, due to the expansion effect of the first spring 30. The mechanism then moves at high speed from the loaded switch open position C1 of FIG. 3 to the switch closed position C2 of FIG. 4. This high-speed clockwise pivoting of the center cam 31B causes an equal pivoting of the center crank 31A and consequently pivoting of the crank spindle 41. This pivoting of the spindle 41 causes an outward longitudinal movement of the secondary rod 42, clockwise rocking of the transformation countergear 43, movement of the transformation operating spindle 45, movement (to the right in the drawing) of the main drive rod 44 and finally, counterclockwise rotation of the main shaft 10, thus bringing about closing of the electrical contacts in order to move the switch to the switch closed position C2 (FIG. 4).

Movement of the closing triggering arm 37 can be performed either manually or by means of any actuating means, for example an electromagnetic means.

At the beginning of the passage from the loaded switch open position (FIG. 3) to the switch closed position (FIG. 4), the first spring 30 is the more compressed and consequently the force of the spring is at a maximum level, this force then decreasing to reach a minimumlevel when the switch has reached the switch closed position C2 (FIG. 4). However, the movement transformation system which essentially comprises the parts 42, 43, 44, 45, 46 and enables this decreasing spring force characteristic to be modified by acting in such a way that, on the contrary, at the level of the main shaft 10, the actuating force of the electrical contacts is increasing when the mechanism moves from the open position C1 to the switch closed position C2 and is decreasing when the mechanism moves from the switch closed position C2 to the open position C1. In addition, the movement transformation system also makes it possible to act in such a way that, at the level of the main shaft 10, the actuating force of the electrical contacts is increasing when the mechanism moves from the open position C1 to the switch earthed closed position C3. These transformations of characteristics are made possible by the fact that the kinetic ratio between the movement of the center crank 31A and the main shaft 10 varies according to the angle at which the center crank 31A is pivoted.

Figure 5:
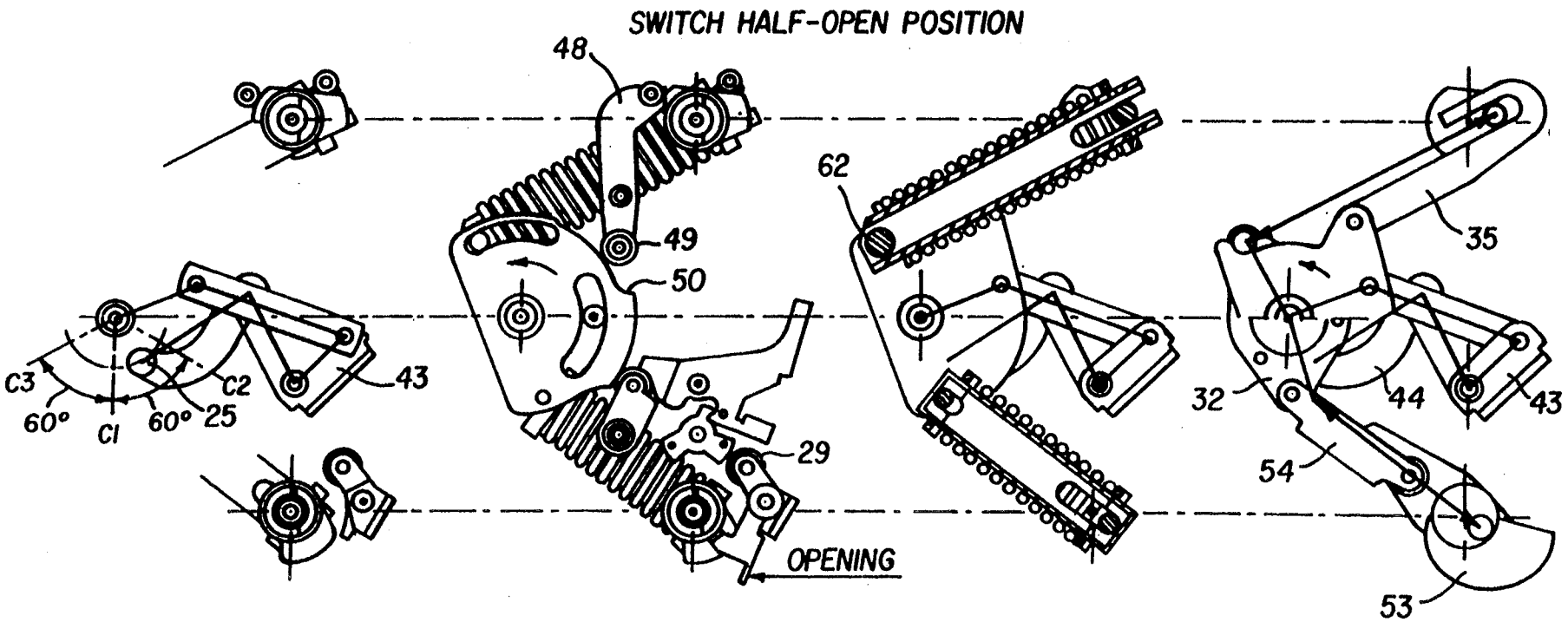
FIG. 5 is an exploded view of the mechanism of FIG. 1 in a transient position when moving from the switch closed position to the open position.
Figure 6:
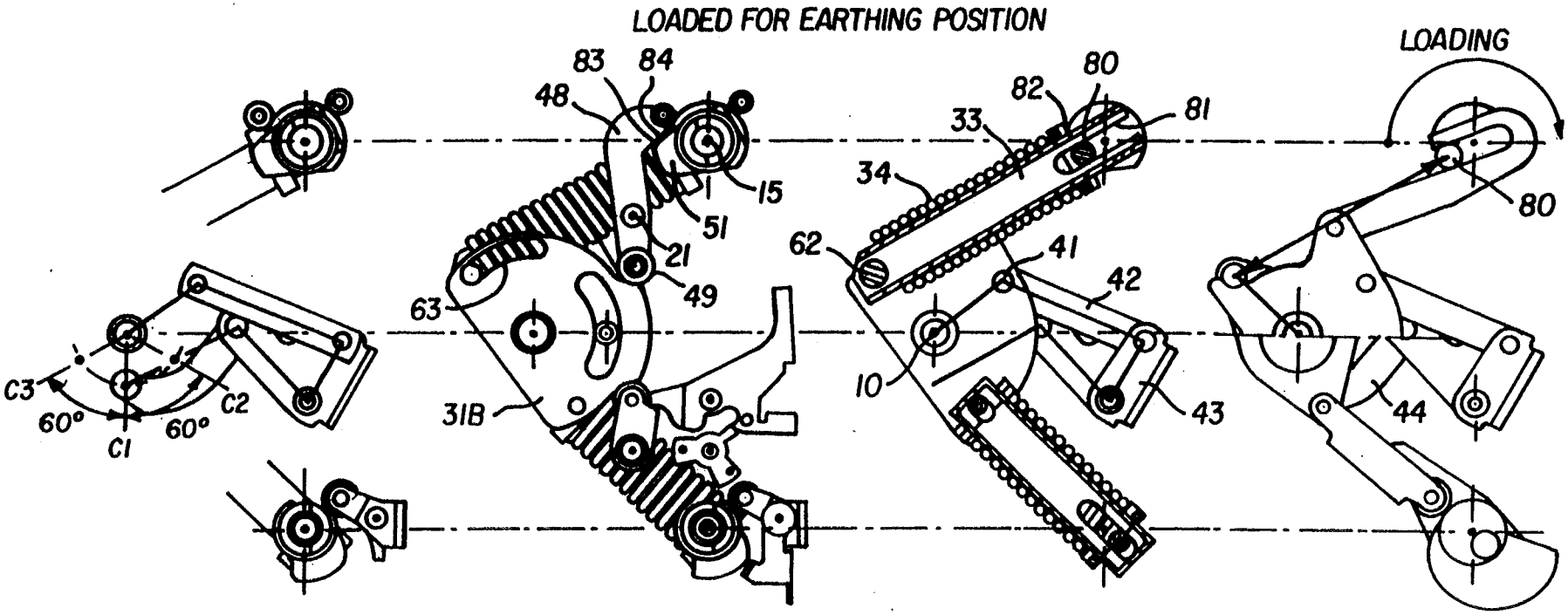
FIG. 6 is an exploded view of the mechanism of FIG. 1 in the loaded open position with a view to earthing closing.

When the mechanism is in the switch closed position C2, the first spring 30 is relaxed and the second spring 34 is compressed. The first spring loading crankshaft 27 is in addition held in position due to the fact that the crankshaft protuberance 71 bears, at the level of the leading edge 28 of the protuberance 71, against a roller 29 mounted on the free end of the opening triggering lever 56. The mechanism being in the switch closed position C2, the opening triggering lever 56 merely has to be actuated by clockwise rotation. The opening triggering lever can be actuated either manually or by means of any actuating means, for example an electromagnetic means. At that moment, as represented in FIG. 5, the protuberance 71 of the first spring loading crankshaft 27 is released from the roller 29 and the crankshaft 27 then rotates freely at high speed to return to its initial position, as represented in FIG. 5. This rotation of the crankshaft 27 takes place in the same direction as in the course of the loading operation, i.e., clockwise, and this is possible because, when loading takes place, the eccentric first spring loading spindle 64 has passed the top dead point (i.e. the spindle 64 has been located during the loading operation beyond a line joining the spindle 60 to the spindle 14). The crankshaft 27 in .its high-speed rotation drives the second spring loading cam 53 and, as the shape of this cam is a helix extending over about 180° and stopping suddenly, the beginning of rotation of this cam 53 releases its contact with the roller 67, which has the consequence that the second spring loading plate 32 is no longer held in rotation by the second spring loading rod 54, and this plate 32 can then rotate counterclockwise at high speed due to the compression force of the second spring 34. This results in the second spring end spindle 62 moving counterclockwise at high speed and, as this spindle 62 is housed in the circular slot 63, it hits the left-hand end of this slot 63 with an impact, drives the center cam 31B in counterclockwise rotation (with an impact) to move this cam to the switch open position as represented in FIG. 2. In this switch open position, the two springs 30 and 34 are then relaxed and the mechanism has therefore returned to its unloaded switch open position.

Figure 7:
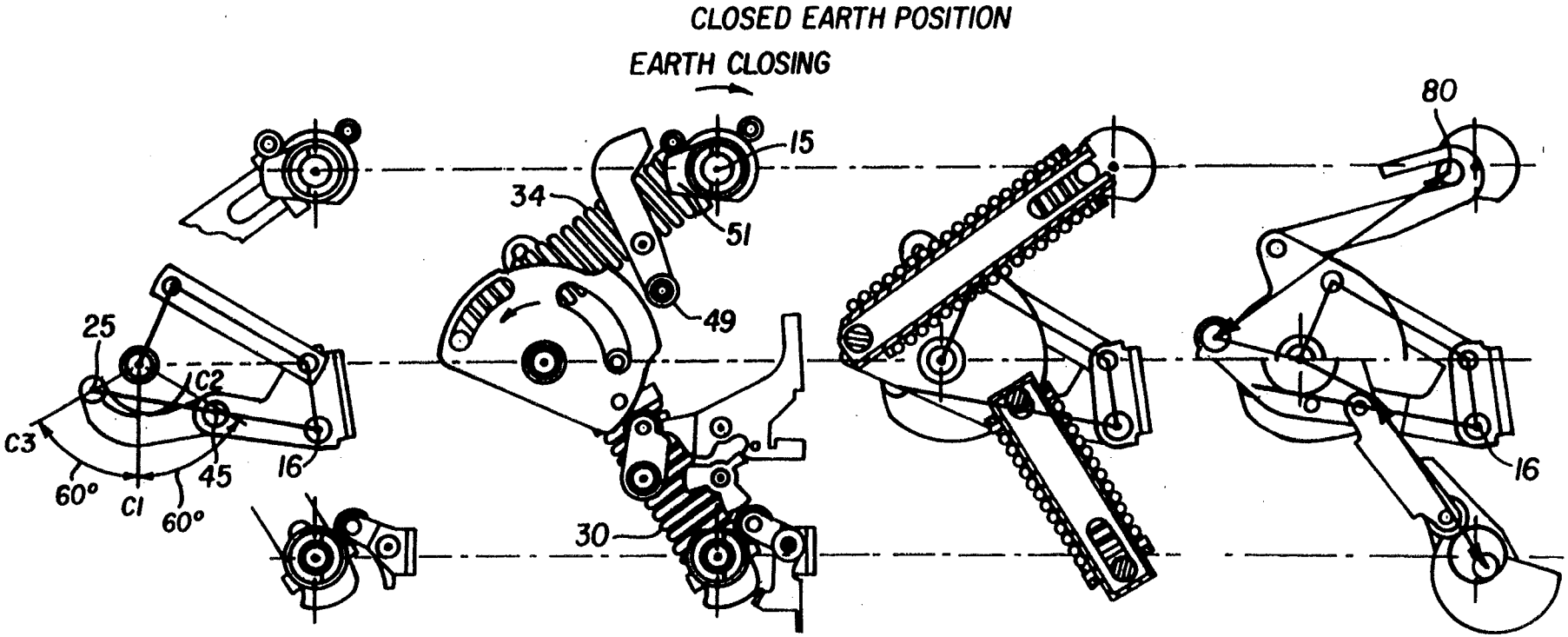
FIG. 7 is an exploded view of the mechanism of FIG. 1 in the earthed closed position.
Figure 8:
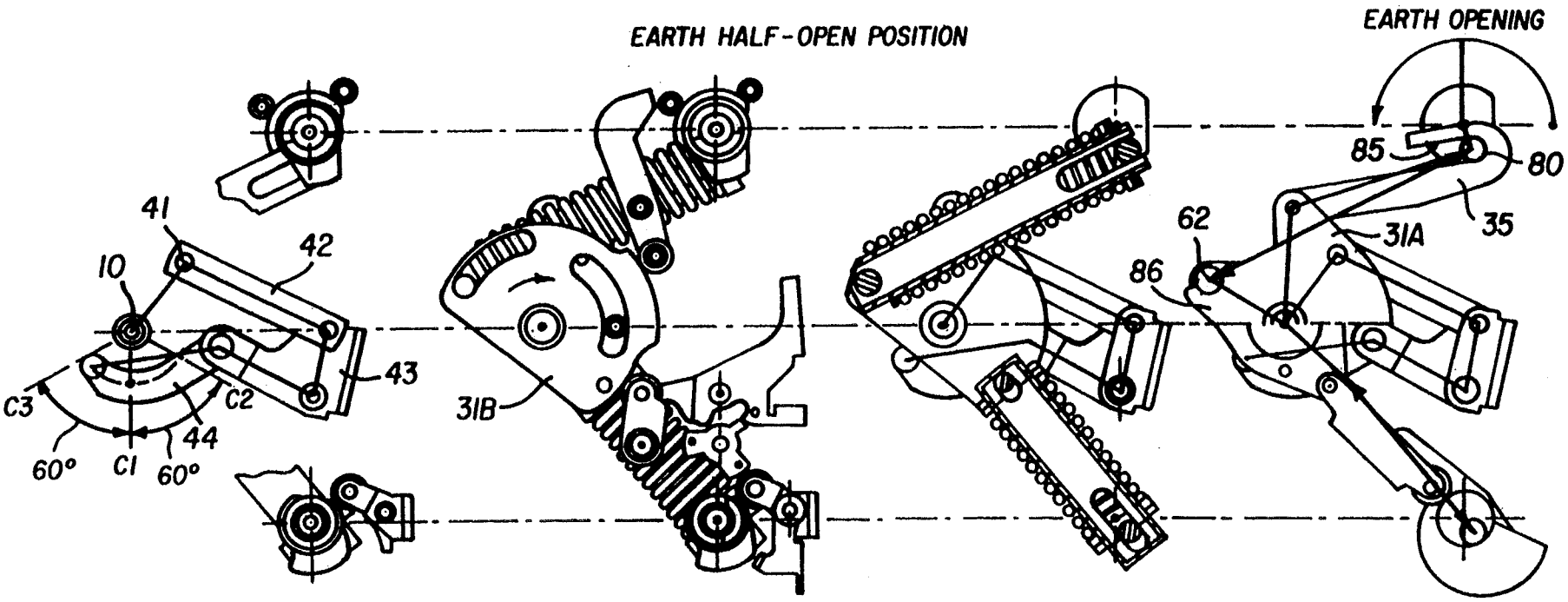
FIG. 8 is an exploded view of the mechanism of FIG. 1 in a transient position when moving from the earthed closed position to the open position.

When the mechanism is in the unloaded switch open position (FIG. 2), it can also be actuated to move it to the earthed closed position (FIG. 7). To achieve this, the mechanism is first loaded, i.e. the mechanism is moved to its loaded open position, in order to close the earthing of FIG. 6. To do this, the earth operating spindle 15 is actuated. This earth operating spindle 15 comprises a second spring loading crankshaft 51 which comprises an eccentric second spring loading spindle 80 which moves in a slot 81 arranged in the distal end of the second spring guide 33 bearing against a bearing part 82, in such a way that rotation of the crankshaft 51 causes movement of the spindle 80 in the slot 81, this movement causing the corresponding movement of the bearing part 82 and consequently compression of the second spring 34. This actuation of the earth operating spindle 15 consists in rotating it through about 180° to move it to the position represented in FIG. 6. In this position, compression of the second spring 34 brings about a leftward thrust of the proximal end of the second spring guide 33 and consequently of the second spring end spindle 62, since this spindle 62 is fixed to the second spring guide 33. The second spring end spindle 62 is engaged in the slot 63 of the center cam 31B and is right up against the left-hand end of this slot, in such a way that the spindle 62 pushes the center cam 31B in the direction of its counterclockwise rotation. However, the center cam 31B is prevented from rotating in this way by means of an earth closing maintaining lever 48. This lever 48 is pivotally mounted around a fixed spindle 21 and its proximal end comprises a roller 49. The lever 48 is held in a position which is such that the roller 49 is applied against the circumference of the center cam 31B being stopped against a bearing face 50 of the center cam 31B, in such a way that the earth closing maintaining lever 48 prevents the counterclockwise rotation of the center cam 31B. In this loaded open position with a view to earthing closing (FIG. 6), a protuberance 83 of the crankshaft 51 comes near to and facing a distal end 84 of the lever 48, and continued rotation of the crankshaft 51 through a small angle of rotation causes the protuberance 83 to come into contact with the distal end 84 and then causes this distal end 84 to be thrust in such a way that the lever 48 pivots counterclockwise and the roller 49 is therefore released from its engagement with the cam profile 74 of the center cam 31B releasing this center cam which can then rotate counterclockwise at high speed due to the action of the second spring 34 via the second spring end spindle 62 thus moving the mechanism to the earthed closed position due to the corresponding rotation of the main shaft 10. This earthed closed position is represented in FIG. 7.

If we then want to move the mechanism from the earthed closed position to the switch open position represented in FIG. 2, the earth operating spindle merely has to be rotated again counterclockwise through about 180° to move it back to its initial position. This operation which corresponds to a transient position when going from the earthed closed position to the open position can be seen in FIG. 8. In this figure, it can be seen that the mechanism comprises in addition an earth opening rod 35 which is connected by articulation to the center crank 31A and which comprises at its other end a slot 85, closed at its distal end side, in which the spindle 80 slides. During the rotational movement of the crankshaft 51 in the course of the operation consisting in moving the mechanism from the earthed closed position to the open position, the spindle 80 which rotates with the crankshaft 51 bears against the distal end of the s lot 85 and consequently causes longitudinal movement of the earth opening rod 35 in the direction of its separation from the center part of the mechanism, and this outward movement of the rod 35 causes clockwise rotation of the center crank 31A. This center crank 31A comprises in addition a finger 86 which, in the earthed closed position, bears against the second spring end spindle 62, which results in this clockwise rotation of the center crank 31A causing on the one hand actuation of the main shaft 10 moving to the open position and on the other hand a certain partial compression of the second spring 34. The finger 86 also serves the purpose of transmitting the compression force of the second spring 34 to the center crank 31A, this center crank being pushed in the direction of a counterclockwise pivoting, due to the action of the spring 34.

In the whole of the description which has just been given with reference to FIGS. 2 to 8, the rocker 36 has been described in such a way that, when the operation moving the mechanism from the unloaded open position to the loaded open position takes place, this rocker 36 moves from a position (FIG. 2) in which it prevents pivoting of the secondary closing latch 37 (due to the position of its locking finger 55) to a position in which it unlocks the secondary closing latch 37 (due to the fact that its locking finger 55 is then facing the recess 76 of the latch 37). In an alternative assembly, the same rocker 36 can be used but turned, as represented in the broken line in the bottom part of FIGS. 3 and 4, in such a way that, in this turned position of the rocker 36, its locking finger 55 pushes a protuberance 87 in such a way that, near the end of the movement which moves the mechanism to the loaded open position, the finger 55 pushes on the protuberance 87 to make the secondary closing latch 37 automatically pivot clockwise, thus automatically triggering the high-speed closing action which moves the mechanism to the switch closed position represented in FIG. 4.

The essential features of operation of the mechanism according to the present invention are as follows..when the mechanism is loaded by means of the switch operating spindle 14, compression of both the first spring 30 and second spring 34 is brought about. This double compression has the consequence that after this initial loading, relaxation of the first spring 30 will cause high-speed actuation of the mechanism to move it to the switch closed position C2, and then relaxation of the second spring 34 will cause high-speed actuation of the mechanism to move it to the initial open position C1. Moreover, when the earth operating spindle is actuated to load the mechanism which is in the open position C1 to move it to the earthed closed position, the first spring 30 remains relaxed and the second spring 34 is compressed, which then enables this compressed spring 34 to actuate the mechanism at high speed to move it to the earthed closed position C3. There is no means of subsequently moving the mechanism back at high speed, by means of relaxation of a spring, from the earthed closed position C3 to the open position C1, but this does not constitute a major drawback since there is in principle no strong current flowing through the electrical earthing closing contacts. Furthermore, the fact that the rocker 36 is formed by a part which, depending on whether it is mounted in a certain way (as represented by the unbroken line) or the other way (as represented by the broken line), has the advantage that the mechanism can be built up either in such a way that after the mechanism loading operation the secondary closing latch 37 has to be actuated manually to bring about closing, or the mechanism can be built up in such a way that the end of the movement which brings about loading of the mechanism automatically causes its triggering with a view to automatic closing.

Moreover, on closing (going from C1 to C2), the mechanism actuating force (produced by relaxation of the first spring or of the second spring) is a force which is initially great and which will then decrease, which is a drawback to efficient operation of the switch. The movement transformation system enables these forces to be made to increase at the level of the main shaft 10. Global operation of the operating mechanism according to the invention When the switch closing operation is performed, the first spring 30 serves the purpose of triggering closing (with an increasing force obtained by means of the movement transformation system).

When the opening operation is performed, the first spring 30 serves the purpose of triggering opening by acting on the second spring drive cam 53, this spring 30 also serves the purpose of slowing down the end of opening (because at the end of counterclockwise movement of the center crank 31A, the spring 30 starts compressing), and the second spring 34 serves the purpose of providing most of the actuating energy (by producing an impact effect to trigger opening of the electrical contacts, this impact being produced by the spindle 62 coming into contact with the left-hand end of the slot 63—FIG. 5).

When the earthing closing operation is performed, the first spring 30 serves the purpose of slowing down the beginning of closing (by exerting a clockwise thrust on the second spring loading plate 32 at the beginning of earthing closing (FIG. 6), this thrust then being reversed, when passing a dead point, thus contributing to increasing the forces towards the end of the earthing closing movement (FIG. 7)) and the second spring 34 serves the purpose of providing most of the earthing closing actuating energy.

We claim:

1. An actuating mechanism of a three-position switch, comprising:

a main shaft for actuating electrical contacts and adapted to be selectively rotated between three stable positions, an open position and, on each side of the open position, respectively a switch closed position and a grounded closed position;

a center crank which is pivotally mounted on the main shaft, said center crank being rotatable between three angular pivoting positions corresponding respectively to said three stable positions; and a mechanical movement transformation system connected to said center crank, said mechanical movement transformation system producing a kinetic ratio between the rotational movement of the center crank and the rotational movement of the main shaft which increases when the center crank rotates from the open position to the switch closed position, whereby a force transmitted to the electrical contacts increases continuously as movement takes place from the open position to the switch closed position.

2. The actuating mechanism according to claim 1, further comprising a first spring and a second spring which are compressed simultaneously when the actuating mechanism is in the open position prior to movement of the actuating mechanism to the switch closed position, wherein moving from the open position to the switch closed position is triggered by elongation of the first spring, and moving from the switch closed position to the open position is triggered by elongation of the second spring.

3. The actuating mechanism according to claim 2, wherein the second spring is compressed when the actuating mechanism is in the open position prior to moving to the grounded closed position, and moving from the open position to the grounded closed position is triggered by elongation of the second spring.

4. The actuating mechanism according to claim 3, further comprising a second spring loading plate, said first spring being adapted to apply a force to the second spring loading plate during grounded closing movement, said force being reversed upon rotation of the second spring loading plate past a dead point, near an end of the grounded closing movement.

5. The actuating mechanism according to claim 4, further comprising:

a center cam rigidly coupled to the center crank, the center cam and center crank pivoting together around the main shaft and being connected to said mechanical movement transformation system to actuate the electrical contacts via the main shaft;

a loading plate pivoting independently around the main shaft, wherein a first end of the first spring is connected to the center crank, and a first end of the second spring is connected to the second spring loading plate;

a first crankshaft connected to a second end of the first spring for loading the first spring to close the actuating mechanism, to the switch closed position;

a drive cam coupled to the first crankshaft for actuating the second spring loading plate to simultaneously load the second spring for opening the actuating mechanism; and a second crankshaft connected to a second end of the second spring for for loading the second spring to close the actuating mechanism, to the grounded closed position.

6. The actuating mechanism according to claim 5, wherein the first end of the second spring is connected directly to the second spring loading plate via a spindle, said spindle being slidable in an arcuate slot in the center cam, such that the loading plate loads the second spring whereas the spindle slides in the arcuate slot, elongation of the first spring causes pivoting of the center cam in a first direction while the spindle remains fixed and the arcuate slot slides with respect to the spindle, and elongation of the second spring causes movement of the spindle which bears against one end of the arcuate slot causing an impact and pivoting of the center cam in a second direction, opposite the first direction.

7. The actuating mechanism according to claim 5, further comprising:

a rotatable secondary closing latch having a locking finger for preventing closing of the actuating mechanism by preventing rotation of the center cam;

a pivoting rocker having a latching finger which latches said secondary closing latch, said rocker being pivotal to unlatch the secondary closing latch, thus triggering high-speed closing of the actuating mechanism.

* * * * *